US006007122A

United States Patent [19]

Linder et al.

[11] Patent Number: 6,007,122

[45] Date of Patent: Dec. 28, 1999

[54] OUTSIDE DOOR-HANDLE

[75] Inventors: Anton Linder, Neukirchen; Ernst Westerholz, Germering, both of Germany

[73] Assignee: Valeo Deutschland GmbH & Co., Erdweg, Germany

[21] Appl. No.: 08/815,479

[22] Filed: Mar. 11, 1997

[30] Foreign Application Priority Data

Mar. 15, 1996 [DE] Germany ..... 196 10 200

[51] Int. Cl.[6] ..... E05B 3/00

[52] U.S. Cl. ..... 292/336.3; 292/216; 292/DIG. 22

[58] Field of Search ..... 292/DIG. 22, 336.3, 292/216, DIG. 23

[56] References Cited

U.S. PATENT DOCUMENTS

| | | | |
|---|---|---|---|
| 3,719,248 | 3/1973 | Breitschwerdt et al. | 292/DIG. 22 |
| 3,799,596 | 3/1974 | Nozomu et al. | 292/DIG. 22 |
| 3,967,844 | 7/1976 | Torii et al. | 292/336.3 |
| 3,990,531 | 11/1976 | Register | 292/DIG. 22 |
| 4,536,021 | 8/1985 | Mochida | 292/DIG. 22 |
| 5,669,642 | 9/1997 | Kang | 292/DIG. 22 |

FOREIGN PATENT DOCUMENTS

| | | | |
|---|---|---|---|
| 2228384 | 11/1974 | France | 292/DIG. 22 |
| 2841546 | 4/1980 | Germany | 292/DIG. 22 |

*Primary Examiner*—Teri Pham
*Attorney, Agent, or Firm*—Moragn & Finnegan, L.L.P.

[57] ABSTRACT

The invention concerns an external door-handle for automotive vehicles with a supporting frame (supporting shackle) which can be fastened to the door sheet-metal, to which supporting frame (supporting shackle) a door pull is articulated; and with a swivel arm (rotary shackle) articulated in the supporting frame, which swivel arm (rotary shackle) can be operated by the handle; a transmission part, in particular a Bowden cable, is coupled to the swivel arm (rotary shackle), through which the door is opened via transmission parts; a massive block is supported so it can be swiveled against spring pressure; in case of a lateral impact, the massive block is located in a locking position because of its mass, in which locking position it prevents an opening of the door; wherein the massive block is articulated to the swivel arm and, in the locking position, prevents a swiveling of the swivel arm into the open position.

19 Claims, 2 Drawing Sheets

OUTSIDE DOOR-HANDLE

BACKGROUND OF THE INVENTION

The invention involves an external door-handle for automotive vehicles with a supporting frame (supporting shackle) which can be fastened to the door sheet-metal and the like. The door pull is articulated to the supporting frame (supporting shackle). The external door-handle also has a swivel arm (revolving shackle), articulated in the supporting frame, which can be operated by the handle. Coupled to the swivel arm (revolving shackle) is a transmission part, in particular a Bowden cable, through which the door can be opened via transmission parts. A massive block is supported so that it can be swiveled against spring pressure. Because of its mass, the massive block is located, in case of lateral impact, in a locking position in which it prevents an opening of the door.

German Offenlegungsschrift 2023859 discloses supporting a compensating mass on the internal side of a door-handle arrangement. If a compressive force suddenly acts against the external sheet-metal of the door, the compensating mass prevents a swiveling of the handle in the opening direction.

BRIEF SUMMARY OF THE INVENTION

It is the task of the invention to provide, in the case of an external door-handle of the type described at the outset, a massive block which, with simple construction, small dimensions and low weight, will possess a high degree of functionality.

According to the invention, this task is solved in that the massive block is articulated to the swivel arm and, in the locking position, prevents a swiveling of the swivel arm into the open position.

The massive block articulated to the swivel arm, at low weight, requires only little room and provides a high degree of security inasmuch as it always functions in case of a lateral impact.

A particularly secure operation is achieved when the massive block locks in its normal position and can be moved into the non-locking position by manually operating the handle. Alternatively it is proposed that the massive block not lock in its normal position and be moved into the locking position by acceleration due to a lateral impact.

As a preference it is proposed that the massive block in the lock position rest against a forward part of the supporting frame. It is particularly advantageous if the massive block, when in its non-locking position, abut against a stop of the supporting frame. With every swiveling of the swivel arm, caused by the handle, the massive block can be swiveled through its spring into a rotary position which is distant from the normal position. This is particularly advantageous because in this fashion the massive block is swiveled with every operation of the door-handle and therefore cannot freeze in place.

The greatest advantage is obtained if the massive block is supported within a recess of the swiveling arm. Furthermore, the swivel shaft of the massive block should be arranged in parallel to the axis of rotation of the handle and of the swivel arm.

BRIEF SUMMARY OF THE DRAWINGS

An example of an embodiment of the invention is shown in the drawings and is described in greater detail below. The drawings show.

DETAILED DESCRIPTION OF THE INVENTION

Figure 1:
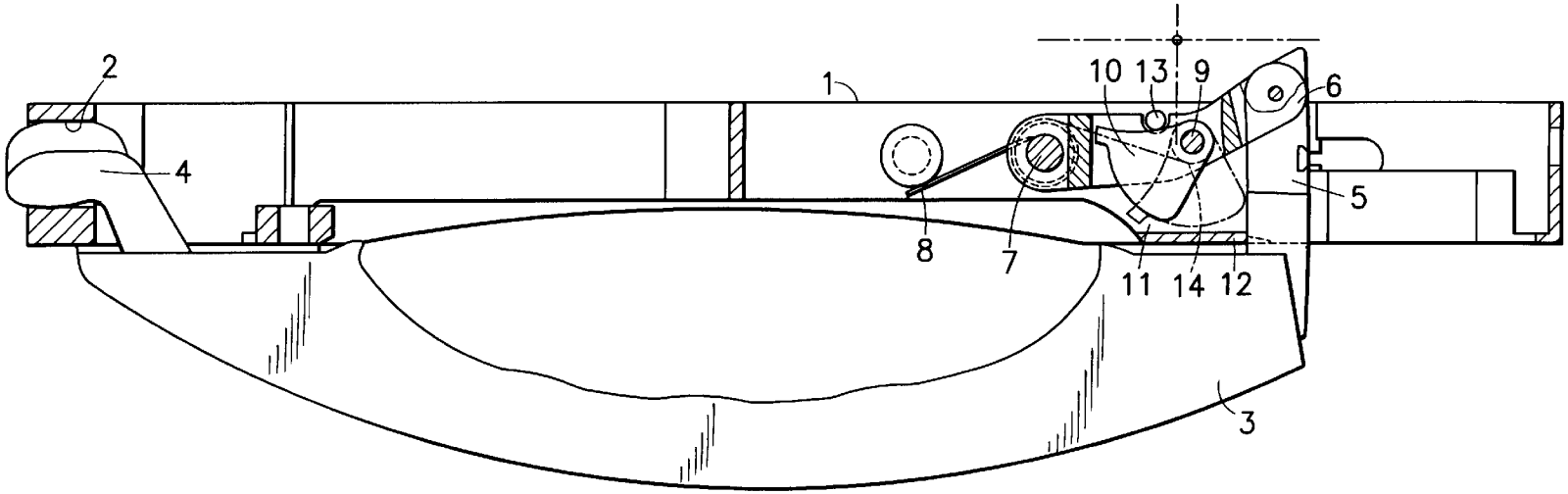
FIG. 1 is a lengthwise section through the external door-handle, in a first form of embodiment.
Figure 2:
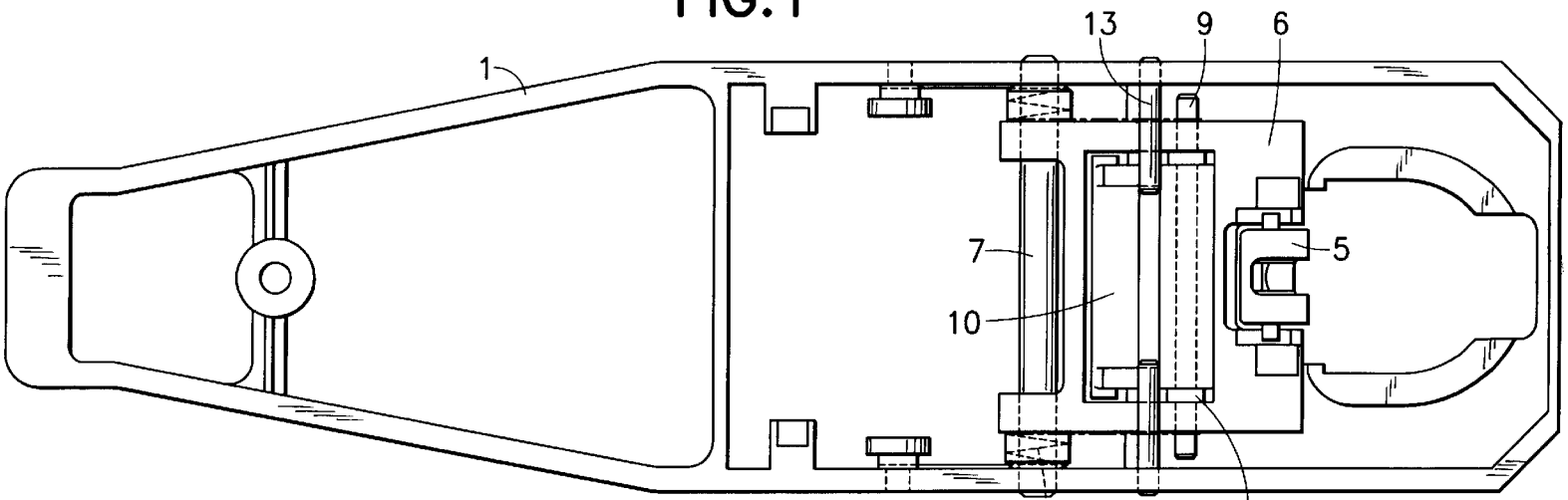
FIG. 2 is a lateral view of the supporting frame, without the handle.

As an overall installation, the external door-handle has a supporting frame 1 which is fastened to the inner side of the external sheet-metal of an automotive vehicle. At one end the supporting frame 1 has a recess 2. The door pull 3, which is arranged externally to the door, fits with a projection 4 that is arranged at its end, into the recess 2. In this fashion, recess 2 and projection 4 form an articulation around which the handle 3 can be swiveled.

On the handle 3, at the end opposite to projection 4, there juts out a finger-shaped shank 5, protruding inward. The end of shank 5 abuts against the end of a swiveling arm 6, so that whenever the handle 3 is pulled outwardly, the swivel arm 6 can be swiveled outwardly. In so doing, the swivel arm 6 is rotationally mobile around a shaft 7 on which a spring 8 is arranged which spring stresses the swivel arm 6 against the tensile force of handle 3.

The end of a Bowden cable (not shown) is fastened to the end of swivel arm 6 and/or shank 5; through the operation of the Bowden cable the door lock is opened.

There is a rectangular opening in swivel arm 6 in which a swivel-shaped massive block 10 is supported so as to be capable of swiveling around a shaft 9 which is fastened to swivel arm 6. The shafts 7, 9 are parallel to each other and parallel to the axis of rotation of handle 3.

The mass and/or the weight of the massive block 10 is smaller than that of handle 3 and of the swivel arm 6. Consequently, if the lock is accelerated crosswise to the driving direction of the automotive vehicle, the massive block 10 swings outward before the handle 3 and the swivel arm 6. In this fashion the massive block 10 reaches a free space 11 between the swivel arm 6 and a forward plate-shaped part 12 of the support frame 1. In this lock position of the massive block 10, the massive block 10 prevents the swivel arm 6 together with the handle 3 from moving outward, because, in this locked position, the massive block straddles the interval between the shaft 9 and the part 12.

In the non-locking position, the massive block 10 abuts against at least one stop 13, which is fastened to the supporting frame 1 in the form of a pin and therefore straddles the supporting frame in its parallel position to the shafts 7, 9. If the handle 3 is pulled outward with normal operation, the swivel arm 6 also swivels outward, whereby the shaft 9 and the massive block 10 are moved along. In this fashion the shaft 9 distances itself from stop 13, in a manner such that the massive block 10 is swiveled inward. In this fashion, whenever the handle 3 is operated, the massive block 10 is moved and thereby its easy operation is preserved.

The constant abutting of massive block 10 against stop 13 is caused by a torsion spring 14 which is arranged around the shaft 9. The spring 14 can either be a double spring or be made up of two springs in order to ensure that even if one spring breaks there will always remain some spring action.

Figure 3:
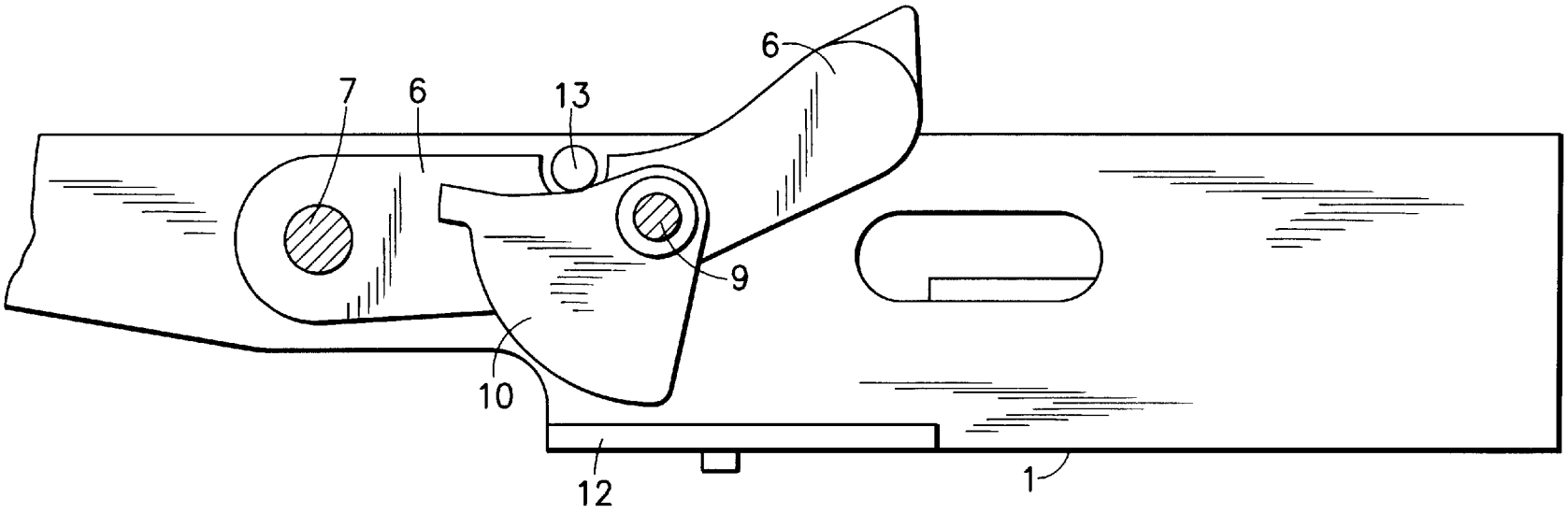
FIG. 3 is a lengthwise section through the external door-handle, in a second form of embodiment.

In the alternative embodiment shown in FIG. 3, the massive block 10 is in the normal position—i.e., when the door-handle is not operated and there is no lateral impact, it is in the locking position as shown in FIG. 3. If the door is manually opened by pulling on the handle, the swivel arm 6 is swiveled and the shaft of the massive block is shifted thereby in a manner such that the massive block is swiveled—specifically, by its spring—from its locking position into a non-locking position, because the shaft 9 of the massive block 10 distances itself from the stop 13. In case of a lateral impact the massive block remains in a locking position.

The invention claimed is:

1. An external door handle of an automotive vehicle, comprising:

a supporting frame for fastening to the door;

a door pull articulatcd to the supporting frame;

a swivel arm operated by the door pull through which the door is selectively opened;

a massive block having a free end and an end articulated to the swivel arm and supported to be swiveled selectively, through inertia, into a locking position in which it prevents opening of the door and, under spring action, into a non-locking position; and wherein the articulated end of the massive block is supported by the supporting frame and positioned opposite the door such that in the locking position, the free end of the massive block swivels towards the door pull to prevent swivelling of the swivel arm into an open position thus preventing the door handle from moving into the open position.

2. An external door-handle according to claim 1, wherein the massive block locks and can be moved into the non-locking position by operating the handle.

3. An external door-handle according to claim 2, wherein the swivel shaft of the massive block is arranged in parallel to the axis of rotation of the handle and of the swivel arm.

4. An external door-handle according to claim 1, further comprising a swivel shaft for the massive block which is parallel to the axes through which the swivel and handle pivot.

5. An external door handle of an automotive vehicle, comprising:

a supporting frame for fastening to the door;

a door pull articulated to the supporting frame;

a swivel arm operated by the door pull through which the door is selectively opened;

a massive block having a free end and an end articulated to the swivel arm and supported to be swiveled selectively, thorugh inertia, into a second position in which it prevents opening of the door and, under spring action, into a first position;

wherein the articulated end of the massive block is supported by the supporting frame and positioned opposite the door pull such that in the second position, the free end of the massive block swivels towards the door pull to prevent swivelling of the swivel arm into an open position thus preventing the door handle from moving into the open position; and wherein the massive block does not lock in the first position and can be moved into the second position.

6. An external door-handle according to claim 5, wherein the massive block in the locking position rests against a part of the supporting frame.

7. An external door-handle according to claim 5, wherein the massive block is supported within a recess of the swivel arm.

8. An external door-handle according to claim 3, wherein the swivel shaft of the massive block is arranged in parallel to the axis of rotation of the handle and of the swivel arm.

9. An external door handle of an automotive vehicle, comprising:

a supporting frame for fastening to the door;

a door pull articulated to the supporting frame;

a swivel arm operated by the door pull through which the door is selectively opened;

a massive block having a free end and an end articulated to the swivel arm and supported to be swiveled selectively, through inertia, into a locking position in which it prevents opening of the door and, under spring action, into a non-locking position;

wherein the articulated end of the massive block is supported by the supporting frame and positioned opposite the door pull such that in the locking position, the free end of the massive block swivels towards the door pull to prevent swivelling of the swivel arm into an open position thus preventing the door handle from moving into the open position; and wherein the massive block in the locking position rests against a part of the supporting frame.

10. An external door-handle according to claim 9, wherein the massive block is supported within a recess of the swivel arm.

11. An external door-handle according to claim 9, further comprising a swivel shaft for the massive block which is parallel to the axes through which the swivel and handle pivot.

12. An external door handle of an automotive vehicle, comprising:

a supporting frame for fastening to the door;

a door pull articulated to the supporting frame;

a swivel arm operated by the door pull through which the door is selectively opened;

a massive block having a free end and an end articulated to the swivel arm and supported to be swiveled selectively, through inertia, into a locking position in which it prevents opening of the door and, under spring action, into a non-locking position;

wherein the articulated end of the massive block is supported by the supporting frame and positioned opposite the door pull such that in the locking position, the free end of the massive block swivels towards the door pull to prevent swivelling of the swivel arm into an open position thus preventing the door handle from moving into the open position; and wherein the massive block in its non-locking position abuts against the supporting frame.

13. An external door-handle according to claim 12, wherein the massive block is supported within a recess of the swivel arm.

14. An external door-handle according to claim 12, further comprising a swivel shaft for the massive block which is parallel to the axes through which the swivel and handle pivot.

15. An external door handle of an automotive vehicle, comprising:

a supporting frame for fastening to the door;

a door pull articulated to the supporting frame;

a swivel arm operated by the door pull through which the door is selectively opened;

a massive block having a free end and an end articulated to the swivel arm and supported to be swiveled selectively, through inertia, into a locking position in which it prevents opening of the door and, under spring action, into a non-locking position;

wherein the articulated end of the massive block is supported by the supporting frame and positioned opposite the door pull such that in the locking position, the free end of the massive block swivels towards the door pull to prevent swivelling of the swivel arm into an open position thus preventing the door handle from moving into the open position; and wherein the massive block is supported within a recess of the swivel arm.

16. An external door-handle according to claim 15, further comprising a swivel shaft for the massive block which is parallel to the axes through which the swivel and handle pivot.

17. An external door handle of an automotive vehicle, comprising:

a supporting frame for fastening to the door;

a door pull articulated to the supporting frame;

a swivel arm operated by the door pull through which the door is selectively opened;

a massive block having a free end and an end articulated to the swivel arm and supported to be swiveled selectively, through inertia, into a locking position in which it prevents opening of the door and, under spring action, into a non-locking position:

wherein the articulated end of the massive block is supported by the supporting frame and positioned opposite the door pull such that in the locking position, the free end of the massive block swivels towards the door pull to prevent swiveling of the swivel arm into an open position thus preventing the door handle from moving into the open position;

wherein the massive block in its non-locking position abuts against a block of the supporting frame; and with every swiveling of the swivel arm caused by the door pull, the massive block can be swiveled by the spring action into a rotary position which is spaced from the non-locking position.

18. An external door handle of an automotive vehicle, comprising:

a supporting frame for fastening to the door;

a door pull articulated to the supporting frame;

a swivel arm operated by the door pull through which the door is selectively opened;

a massive block having a free end and an end articulated to the swivel arm and supported to be swiveled selectively, through inertia, into a locking position in which it prevents opening of the door and, under spring action, into a non-locking position;

wherein the articulated end of the massive block is supported by the supporting frame and positioned opposite the door pull such that in the locking position, the free end of the massive block swivels towards the door pull to prevent swivelling of the swivel arm into an open position thus preventing the door handle from moving into the open position;

wherein the massive block locks and can be moved into the non-locking position by operating the handle; and wherein the massive block is supported in a recess of the swivel arm.

19. An external door handle of an automotive vehicle, comprising:

a supporting frame for fastening to the door;

a door pull articulated to the supporting frame;

a swivel arm operated by the door pull through which the door is selectively opened;

a massive block having a free end and an end articulated to the swivel arm and supported to be swiveled selectively, through inertia, into a locking position in which it prevents opening of the door and, under spring action, into a non-locking position; and means for allowing the massive block to be swiveled selectively into the locking position through inertia and spring action and into the unlocking position through inertia and spring action.

* * * * *